US010166457B2

(12) United States Patent
Chen

(10) Patent No.: US 10,166,457 B2
(45) Date of Patent: Jan. 1, 2019

(54) TAPERED TRAMPOLINE ENCLOSURE

(71) Applicant: Samuel Chen, Hong Kong (CN)

(72) Inventor: Samuel Chen, Hong Kong (CN)

( * ) Notice: Subject to any disclaimer, the term of this patent is extended or adjusted under 35 U.S.C. 154(b) by 0 days.

(21) Appl. No.: 15/438,460

(22) Filed: Feb. 21, 2017

(65) Prior Publication Data

US 2018/0236343 A1 Aug. 23, 2018

(51) Int. Cl.

| | |
|---|---|
| ***A63B 71/00*** | (2006.01) |
| ***A63B 5/11*** | (2006.01) |
| *A63B 5/00* | (2006.01) |
| *A63B 71/02* | (2006.01) |

(52) U.S. Cl.

CPC ..... *A63B 71/0054* (2013.01); *A63B 5/11* (2013.01); *A63B 5/00* (2013.01); *A63B 71/022* (2013.01); *A63B 2071/009* (2013.01); *A63B 2071/0063* (2013.01)

(58) Field of Classification Search

CPC ..... A63B 5/11; A63B 71/0054; A63B 5/00; A63B 71/022; A63B 2071/0063; A63B 2071/009

See application file for complete search history.

(56) References Cited

U.S. PATENT DOCUMENTS

| | | | | |
|---|---|---|---|---|
| 6,607,468 | B1 * | 8/2003 | Nichols, Jr. | A63B 5/11 482/27 |
| 6,926,626 | B2 * | 8/2005 | Scarpa, III | A63B 61/02 248/523 |
| 7,150,690 | B1 * | 12/2006 | Cusick | A63B 63/004 473/478 |
| D570,947 | S * | 6/2008 | Horne | D21/797 |
| 7,611,443 | B2 * | 11/2009 | Publicover | A63B 5/11 482/27 |
| 9,492,698 | B2 * | 11/2016 | Andon | A63B 5/11 |
| D794,151 | S * | 8/2017 | Ji | D21/797 |
| D805,595 | S * | 12/2017 | Chen | D21/797 |
| 2006/0270524 | A1 * | 11/2006 | Coiling | A63B 5/11 482/27 |
| 2013/0274070 | A1 * | 10/2013 | Publicover | A63B 5/11 482/27 |
| 2016/0296781 | A1 * | 10/2016 | Andon | A63B 5/11 |

* cited by examiner

*Primary Examiner* — Megan Anderson
(74) *Attorney, Agent, or Firm* — Clement Cheng

(57) ABSTRACT

A trampoline has a frame and the frame includes legs for supporting the frame above a ground surface. A bed is suspended on the frame by springs. The springs attach between the frame and the bed. The enclosure has enclosure poles. The enclosure poles are upwardly extending from the frame so that the enclosure poles terminate at pole tips. The enclosure further includes an enclosure net suspended from the pole tips. Each tapered pole connector panel connects to a respective pole tip on a respective enclosure pole. The tapered pole connector panels are connected to the enclosure net to support the net and hang the net from the pole tips. The plurality of tapered pole connector panels are formed from sheet material.

11 Claims, 6 Drawing Sheets

TAPERED TRAMPOLINE ENCLOSURE

FIELD OF THE INVENTION

The present invention is in the field of trampoline enclosures.

DISCUSSION OF RELATED ART

Trampolines have a variety of different enclosure apparatus for catching wayward users and retaining the users within the bounding area above the trampoline bed.

SUMMARY OF THE INVENTION

A trampoline has a frame and the frame includes legs for supporting the frame above a ground surface. A bed is suspended on the frame by springs. The springs attach between the frame and the bed. The enclosure has enclosure poles. The enclosure poles are upwardly extending from the frame so that the enclosure poles terminate at pole tips. The enclosure further includes an enclosure net suspended from the pole tips. Each tapered pole connector panel connects to a respective pole tip on a respective enclosure pole. The tapered pole connector panels are connected to the enclosure net to support the net and hang the net from the pole tips. The plurality of tapered pole connector panels are formed from sheet material.

A top line is formed as a net strapping line. The net strapping line preferably encloses a net strapping. The net strapping is preferably formed as a sleeve for receiving the net strapping line. The net strapping line can be a cable such as a steel braided cable having a polyethylene sheath. The enclosure poles preferably include at least six vertically oriented enclosure poles and six enclosure covers covering the six vertically oriented enclosure poles. The six enclosure covers can be made of plastic foam. The enclosure net is suspended from an enclosure net strapping. The enclosure net strapping is connected to the plurality of tapered pole connector panels that pulls a strapping line and the enclosure net toward the pole tip. The enclosure net forms a strapping line angle. The strapping line angle is pulled toward the pole tip.

The plurality of tapered pole connector panels are tapered so that a height profile begins at a panel inside edge and diminishes as the height profile reaches the pole tip. The tapered pole connector panel has an arc shaped taper or a linear taper. The tapered pole connector panel further includes an enclosure net reinforcement strip that is vertically oriented. The tapered pole connector panel is attached to the reinforcement strip at a panel upper corner. The enclosure net reinforcement strip is also connected to the tapered pole connector panel at a panel lower tip. The panel inside edge of the tapered pole connector panel is defined between the panel upper corner and the panel lower tip and wherein the panel inside edge is stitched with an elongated stitch to the enclosure net reinforcement strip.

A panel tapered edge extends between the pole tip and the panel lower tip. The panel tapered edge has a curved shape. The panel tapered edge has a parabolic shape that matches the profile of the curve of the enclosure net. The enclosure net extends downwardly to a lower net connection. The lower net connection is formed between the spring cover and the bed. A panel outer tip has a connection cable for connection to the tapered pole connector panel.

Figure 1:
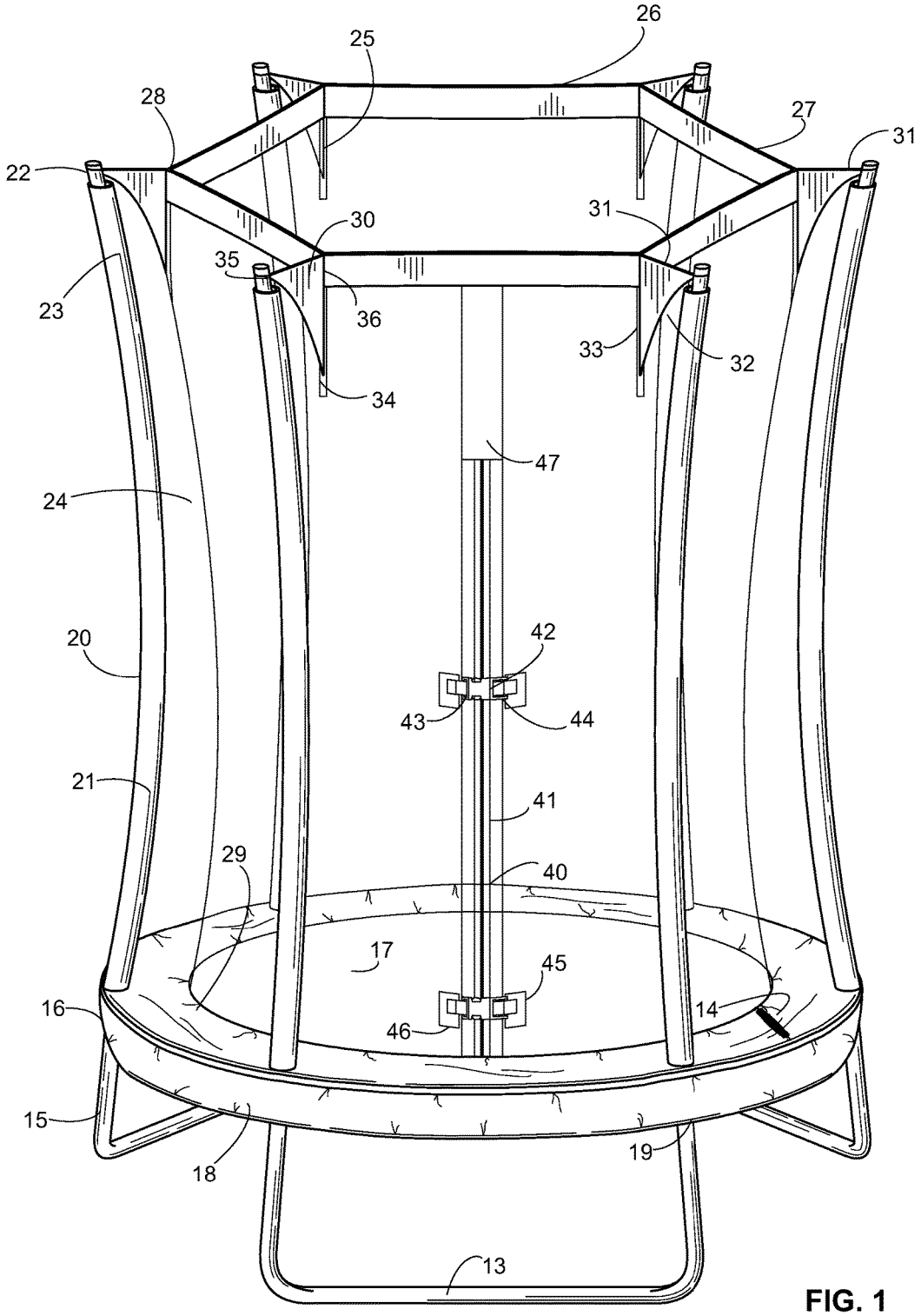
FIG. 1 is a perspective view of the present invention.
Figure 2:
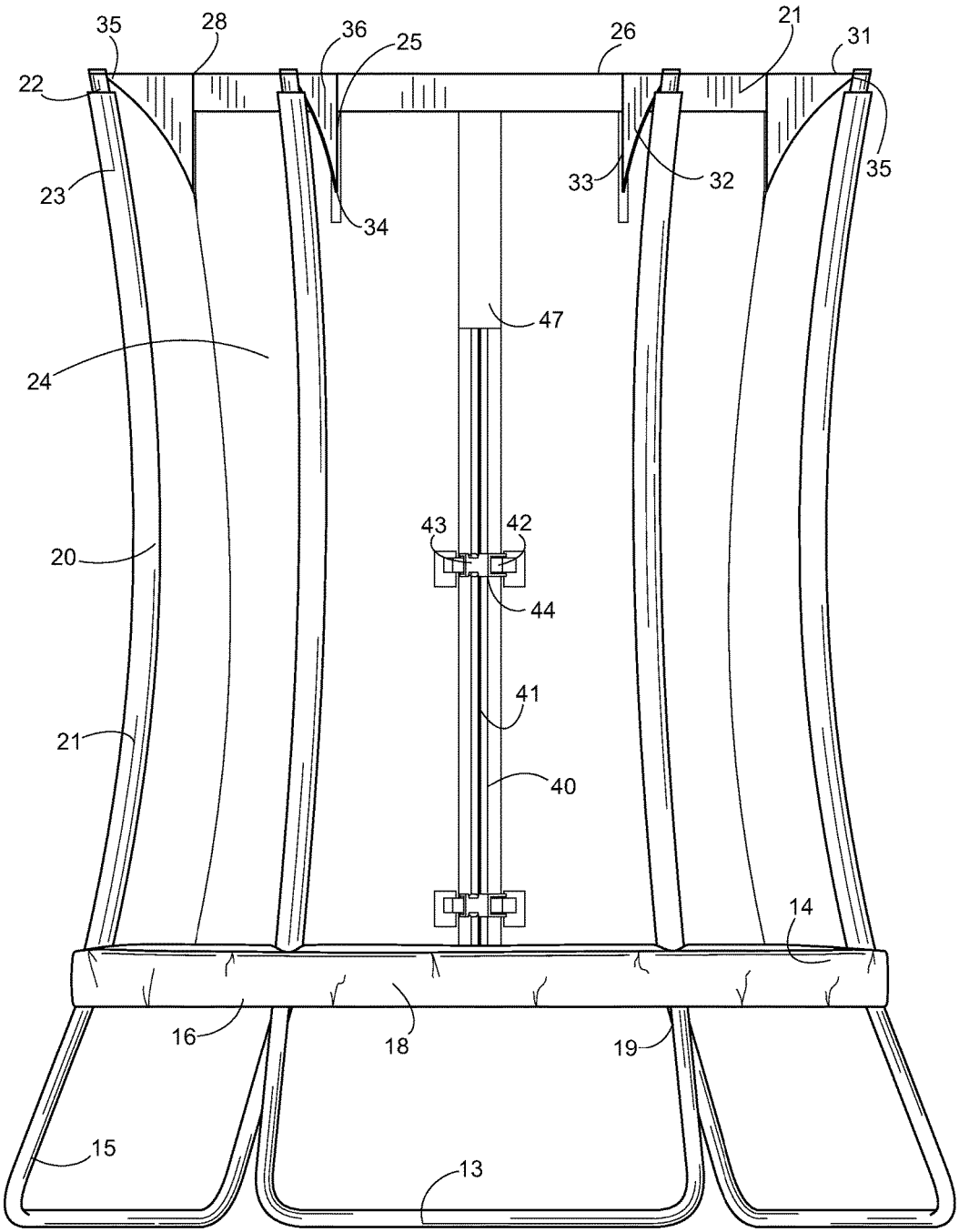
FIG. 2 is a front view of the present invention.
Figure 3:
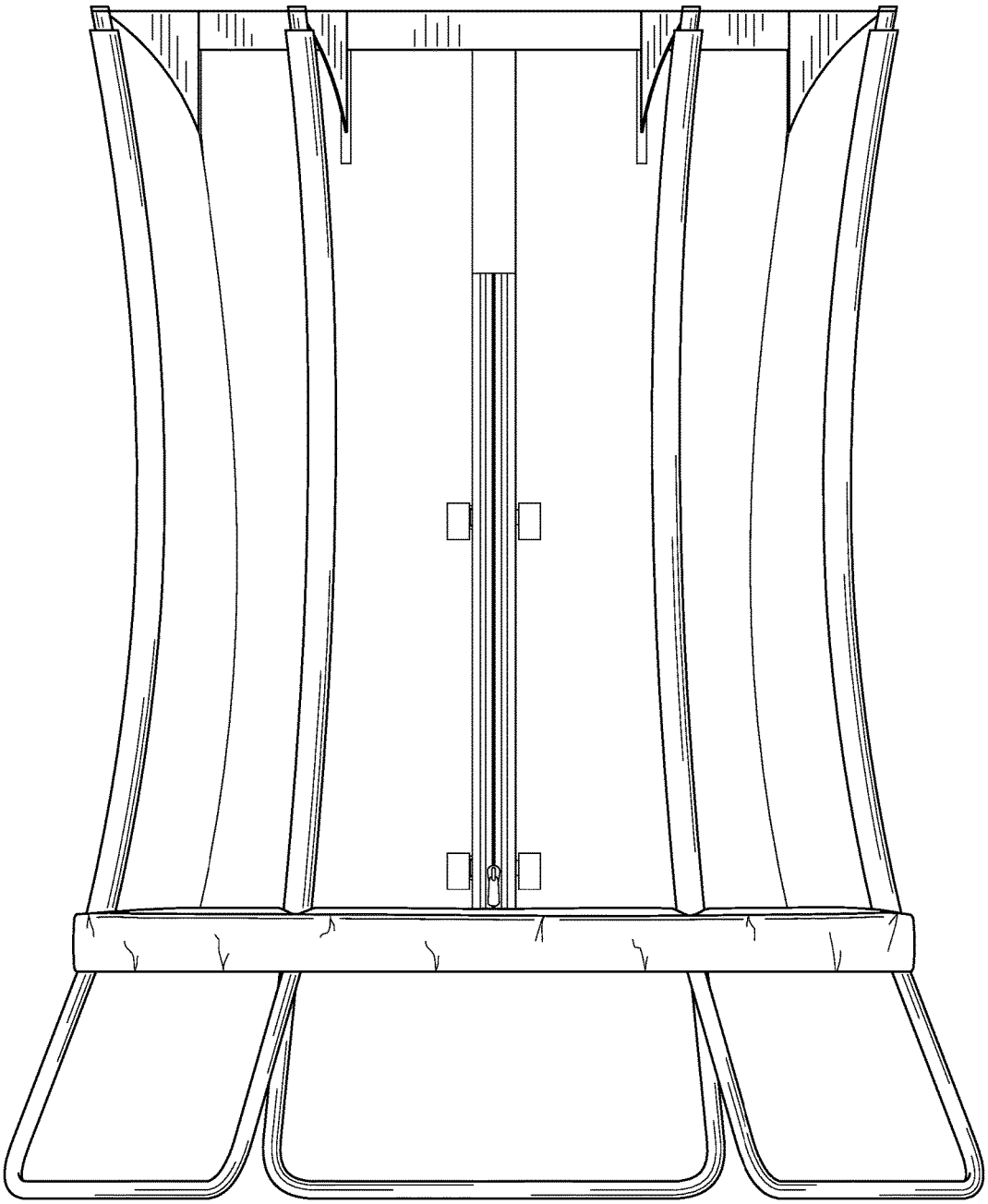
FIG. 3 is a rear view of the present invention.
Figure 4:
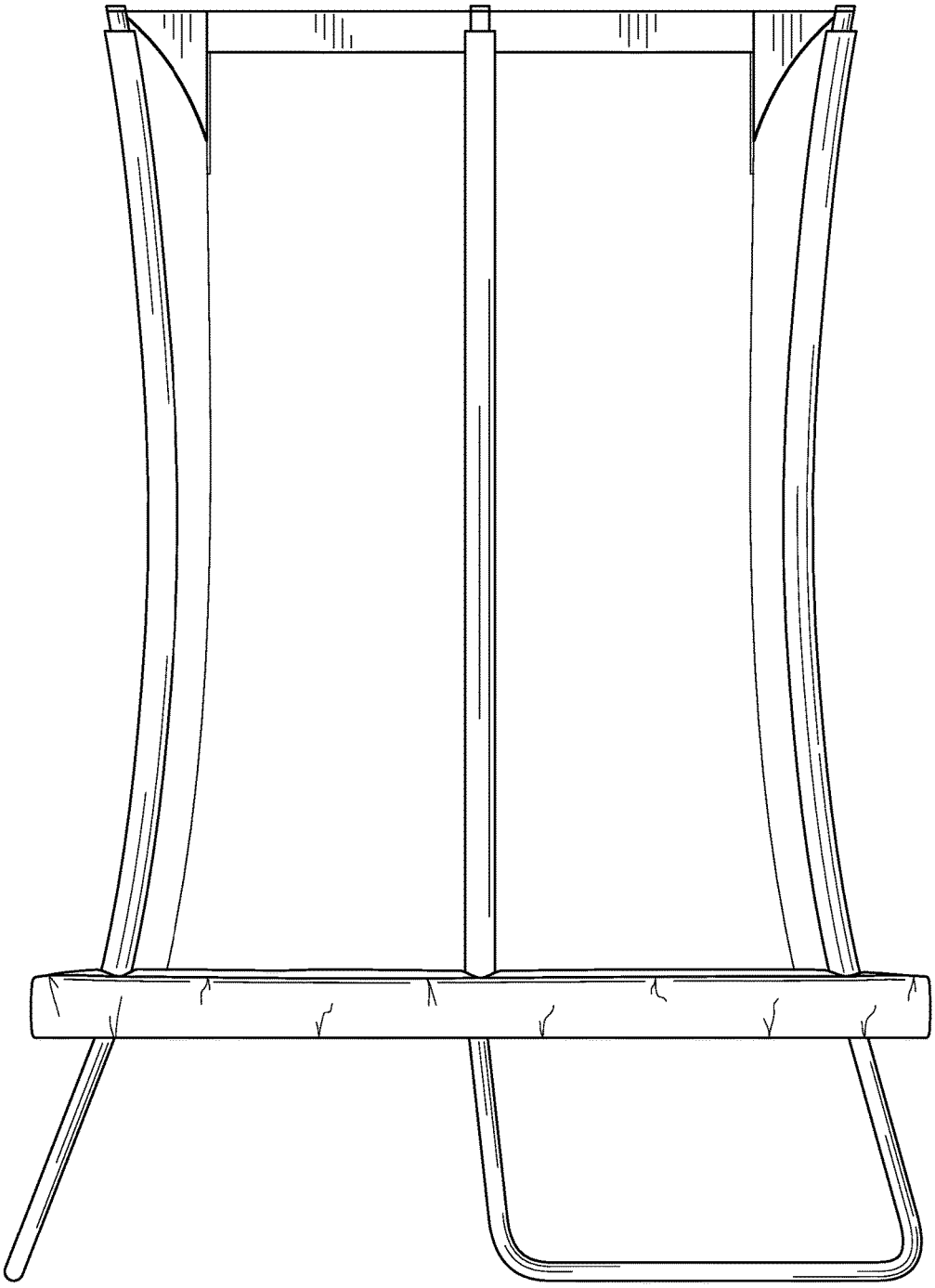
FIG. 4 is a side view of the present invention.
Figure 5:
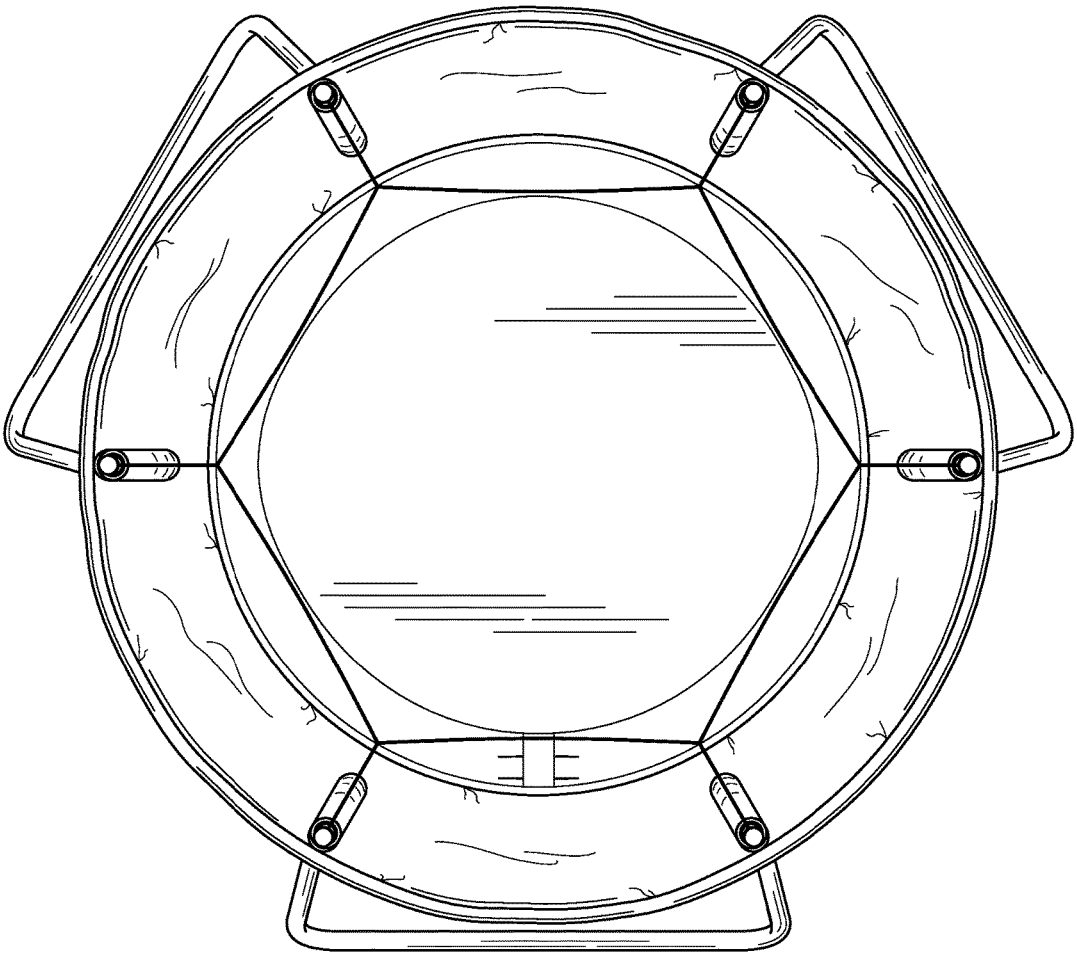
FIG. 5 is a top view of the present invention.
Figure 6:
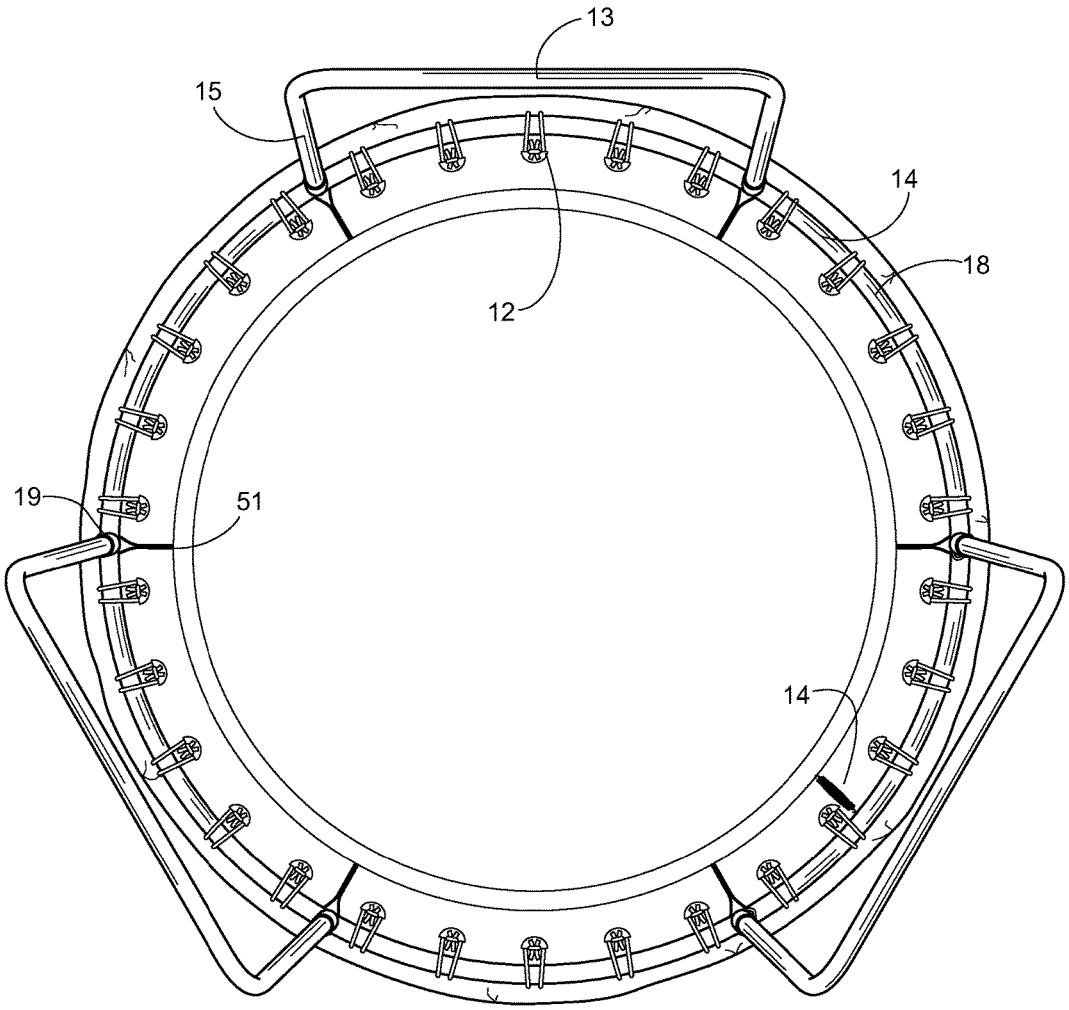
FIG. 6 is a bottom view of the present invention.

The following call out list of elements can be a useful guide in referencing the element numbers of the drawings.

12 Spring Connectors
13 Leg Base
14 Springs
15 Leg
16 Spring Cover
17 Bed
18 Frame
19 Leg Connection
20 Enclosure
21 Enclosure Pole
22 Pole Tip
23 Pole Cover
24 Enclosure Net
25 Enclosure Net Reinforcement Strip
26 Net Strapping Line
27 Net Strapping
28 Strapping Line Angle
29 Lower Net Connection
30 Tapered Pole Connector Panel
31 Panel Upper Edge
32 Panel Tapered Edge
33 Panel Inside Edge
34 Panel Lower Tip
35 Panel Outer Tip
36 Panel Upper Corner
40 Entry
41 Zipper
42 Buckle
43 Buckle Clip
44 Buckle Socket
45 Buckle Socket Panel
46 Buckle Clip Panel
47 Zipper Lead Panel
51 Bed To Frame Connector

DETAILED DESCRIPTION OF THE PREFERRED EMBODIMENT

The present invention includes a frame 18 that holds a bed 17 substantially horizontally suspended across the frame. The frame 18 suspends the bed 17 at springs 14. The springs 14 can be elastic cord or helical springs. The leg base 13 can be made of tubular steel and connected at a leg connection 19 to become a part of the frame 18. The leg base 13 extends to legs 15 past the leg connection 19 to extend upwardly to an enclosure 20. The enclosure poles 21 can extend downwardly into the frame 18 so that the enclosure poles 21 form the legs 15 and the leg base 13. The springs 14 are connected to the bed 17 at spring connectors 12. The spring connectors 12 can be grommets, or panels woven to the edge of the bed 17. The spring connectors 12 can also be made as plastic injection molded hook or buckle members that attach to the bed 17. The springs 14 can be hooked by the spring connectors 12. Additionally, the leg connection 19 can form a downwardly extending socket that receives a bed to frame connector 51. The bed to frame connector 51 can be a cable that pulls the bed 17 toward the leg connection 19. A toroidal spring cover 60 and covers the springs 14 for protection from ultraviolet light. The frame 18 can be made of tubular steel and include the enclosure poles 21 that extend downwardly to the legs 15.

The enclosure 20 includes at least six vertically oriented enclosure poles 21 that may have a swept bent shaped profile. Each enclosure pole 21 terminates at a pole tip 22. The enclosure pole 21 may also have an enclosure cover 23. The enclosure cover 23 can be a soft foam for user safety. The pole tip 22 preferably suspends an enclosure net 24 from the pole tip 22. The enclosure net 24 is suspended from an enclosure net strapping 27. The net strapping 27 can have a top line formed as a net strapping line 26. The net strapping line forms various angles where the tapered pole connector panel 30 pulls the net strapping line 26 toward the pole tip 22. The net strapping line 26 forms a strapping line angle 28 where the strapping line angle 28 is pulled toward the pole tip 22.

The tapered pole connector panel 30 is generally tapered so that its height profile diminishes as it reaches the pole tip 22. The tapered pole connector panel 30 can have an arc shaped taper or a linear taper to form a triangular profile. The tapered pole connector panel 30 is preferably connected to the net strapping 27 and the enclosure net 24 at an enclosure net reinforcement strip 25. The enclosure net reinforcement strip 25 is vertically oriented and is attached to the a panel upper corner 36 of the tapered pole connector panel 30. The enclosure net reinforcement strip 25 is also connected to the tapered pole connector panel 30 at a panel lower tip 34. The panel inside edge 33 of the tapered pole connector panel 30 defined between the panel upper corner 36 and the panel lower tip 34 is preferably stitched with a long stitch to the enclosure net reinforcement strip 25.

The panel inside edge 33 is preferably perpendicular to the panel upper edge 31. The panel upper edge 31 extends between the pole tip 22 and the panel upper corner 36 of the tapered pole connector panel 30. The tapered pole connection panel 30 can be made as a fabric sheet or mesh in a single or double ply configuration. The panel upper edge 31 can be formed as a sleeve for receiving the net strapping line 26 or the net strapping 27. The net strapping 27 can be formed as a sleeve for receiving the net strapping line 26. The net strapping line 26 can be formed as a steel cable or polypropylene cord.

The panel tapered edge 32 extends between the pole tip 22 and the panel lower tip 34. The panel tapered edge 32 can have a straight or parabolic shape. The panel tapered edge 32 can have a parabolic shape that matches the profile of the curve of the enclosure net 24. The enclosure net 24 extends downwardly to a lower net connection 29. The lower net connection 29 is preferably between the spring cover 26 and the bed 17. The panel outer tip 35 can have a connection cable for connection to the tapered pole connector panel 30.

Users may enter the bounding area above the bounding bed 17 through an entry 40. The entry 40 preferably has a zipper 41 to act as a closure. The entry 40 is formed on the enclosure net 24 by stitching the zipper 41 to the enclosure net. The zipper 41 may have a zipper lead panel 47 for extending upwardly to the net strapping 27. The zipper 41 can be reinforced with a buckle 42. The buckle 42 may comprise a buckle socket 44 receiving a buckle clip 43. The buckle socket 44 can be mounted on a buckle socket panel 45 and the buckle clip 43 can be mounted on a buckle clip panel 46. The buckle socket panel 45 and the buckle panel clip 46 are preferably heavy fabric members stitched to the enclosure net 24.

Although not required, the best mode aligns the leg 15 to the enclosure pole 21. The leg 15 can be formed integrally with the enclosure pole 21 as a single piece. As seen in the figures, this provides three U-shaped members that can be attached to the frame 18. The profile of the legs 15 can continue upward to the profile of the enclosure poles 21.

The invention claimed is:

1. A trampoline comprising:

a frame, wherein the frame includes legs for supporting the frame above a ground surface;

a bed suspended on the frame by springs, wherein the springs attach between the frame and the bed;

an enclosure including enclosure poles, wherein the enclosure poles are upwardly extending from the frame so that the enclosure poles terminate at pole tips, wherein the enclosure further includes an enclosure net suspended from the pole tips; and a plurality of tapered pole connector panels, wherein each one of the plurality of tapered pole connector panels connect to a respective one of the pole tips, wherein the plurality of tapered pole connector panels are connected to the enclosure net to support the enclosure net and hang the enclosure net from the pole tips, wherein the plurality of tapered pole connector panels are formed from sheet material, wherein the enclosure net is suspended from an enclosure net strapping, wherein the enclosure net strapping is connected to the plurality of tapered pole connector panels that pull a strapping line inside of the enclosure net strapping and the enclosure net toward the pole tips, wherein the enclosure net forms a strapping line angle, wherein the strapping line angle is pulled toward the pole tips.

2. The trampoline of claim 1, wherein the plurality of tapered pole connector panels are tapered so that a height profile begins at a panel inside edge and diminishes as the height profile reaches the pole tips.

3. The trampoline of claim 2, wherein each of the plurality of tapered pole connector panel has an arc shaped taper or a linear taper.

4. The trampoline of claim 2, wherein each of the plurality of tapered pole connector panels further include an enclosure net reinforcement strip that is vertically oriented, wherein each of the plurality of tapered pole connector panels are attached to the enclosure net reinforcement strip at a panel upper corner, wherein the enclosure net reinforcement strip is also connected to each of the plurality of tapered pole connector panels at a panel lower tip, wherein the panel inside edge of the tapered pole connector panel is defined between the panel upper corner and the panel lower tip and wherein the panel inside edge is stitched with an elongated stitch to the enclosure net reinforcement strip.

5. The trampoline of claim 2, wherein the panel inside edge is perpendicular to a panel upper edge, wherein the panel upper edge extends between a respective pole tip of the pole tips and a panel upper corner of each of the plurality of tapered pole connector panels, wherein the panel upper edge is formed for receiving the strapping line, wherein the enclosure net strapping is formed for receiving the strapping line.

6. The trampoline of claim 1, wherein the strapping line is enclosed by the enclosure net strapping, wherein the enclosure net strapping is formed as a sleeve for receiving the strapping line, wherein the strapping line is a cable.

7. The trampoline of claim 1, wherein the enclosure poles include six vertically oriented enclosure poles and six enclosure covers covering the six vertically oriented enclosure poles, wherein the six enclosure covers are made of plastic foam.

8. A trampoline comprising:

a frame, wherein the frame includes legs for supporting the frame above a ground surface;

a bed suspended on the frame by springs, wherein the springs attach between the frame and the bed;

an enclosure including enclosure poles, wherein the enclosure poles are upwardly extending from the frame so that the enclosure poles terminate at pole tips, wherein the enclosure further includes an enclosure net suspended from the pole tips; and a plurality of tapered pole connector panels, wherein each one of the plurality of tapered pole connector panels connect to a respective one of the pole tips, wherein the plurality of tapered pole connector panels are connected to the enclosure net to support the enclosure net and hang the enclosure net from the pole tips, wherein the plurality of tapered pole connector panels are formed from sheet material, wherein the plurality of tapered pole connector panels are tapered so that a height profile begins at a panel inside edge and diminishes as the height profile reaches the pole tips, wherein each of the plurality of tapered pole connector panels have a panel tapered edge that extends between a respective one of the pole tips and a respective panel lower tip, where each of the panel tapered edges have a curved shape, wherein the enclosure net extends downwardly to a lower net connection, wherein the lower net connection is formed between the springs and the bed, wherein each of the plurality of tapered pole connector panels further includes a panel outer tip, wherein the panel outer tips each have a connection cable to connect to a respective one of the pole tips.

9. The trampoline of claim 8, further comprising:

a top line formed as a net strapping line, wherein the net strapping line is enclosed by a net strapping, wherein the net strapping is formed as a sleeve for receiving the net strapping line, wherein the net strapping line is a cable.

10. The trampoline of claim 8, wherein the enclosure poles include six vertically oriented enclosure poles and six enclosure covers covering the six vertically oriented enclosure poles, wherein the six enclosure covers are made of plastic foam.

11. The trampoline of claim 8, wherein the enclosure net is suspended from an enclosure net strapping, wherein the enclosure net strapping is connected to the plurality of tapered pole connector panels that pull a strapping line inside of the enclosure net strapping and the enclosure net toward the pole tips, wherein the enclosure net forms a strapping line angle, wherein the strapping line angle is pulled toward the pole tips.

* * * * *